US005546171A

United States Patent [19]

Hayashi et al.

[11] Patent Number: 5,546,171

[45] Date of Patent: Aug. 13, 1996

[54] DISPLACEABLE TRANSFER APPARATUS HAVING A POST-TRANSFER GUIDE

[75] Inventors: Shigeki Hayashi; Hiroyuki Ueda; Hirotsugu Ogawa, all of Osaka, Japan

[73] Assignee: Mita Industrial Co., Ltd., Osaka, Japan

[21] Appl. No.: 384,252

[22] Filed: Feb. 6, 1995

[30] Foreign Application Priority Data

Mar. 14, 1994 [JP] Japan ..... 6-041675

[51] Int. Cl.[6] ..... G03G 15/14

[52] U.S. Cl. ..... 355/271; 355/308

[58] Field of Search ..... 355/271, 273, 355/308, 274

[56] References Cited

U.S. PATENT DOCUMENTS

| | | | |
|---|---|---|---|
| 3,685,712 | 8/1972 | Turner et al. | 227/3 |
| 4,174,905 | 11/1979 | DiFrancesco et al. | 355/319 |
| 5,006,902 | 4/1991 | Araya | 355/271 |
| 5,146,280 | 9/1992 | Kisu | 355/219 |
| 5,305,068 | 4/1994 | Sato et al. | 355/308 X |
| 5,376,999 | 12/1994 | Hwang | 355/273 X |

OTHER PUBLICATIONS

English language European Search Report for EP 95102163.3 dated Oct. 27, 1995 (3 pages).

*Primary Examiner*—Nestor R. Ramirez

*Attorney, Agent, or Firm*—Beveridge, Degrandi, Weilacher & Young, LLP

[57] ABSTRACT

A transfer roller which transfers a toner image to a recording sheet fed in a gap between a photoreceptor drum and the transfer roller, and a pre-transfer guide which guides the recording sheet are pushed to be displaceable by a spring by use of a roller so that a predetermined gap is maintained between the photoreceptor drum and the transfer roller and that the positions of the transfer roller and the pre-transfer guide depend on the position of the photoreceptor drum. The recording sheet P on which an image has been transferred is conveyed to a conveying guide. A post-transfer guide which receives the abutment of the end of the image transferred recording sheet and guides the recording sheet to the conveying guide is provided to be displaceable integrally with the transfer roller and the pre-transfer guide. The post-transfer guide is made of a resin with a resistance of $10^{10}\Omega$ to $10^{16}\Omega$.

15 Claims, 4 Drawing Sheets

DISPLACEABLE TRANSFER APPARATUS HAVING A POST-TRANSFER GUIDE

BACKGROUND OF THE INVENTION

1. Field of the Invention

The present invention relates to a transfer apparatus, and more specifically, to a transfer apparatus for use in an image forming apparatus such as an electrographic copying machine, a facsimile apparatus and a printer apparatus.

2. Description of the Prior Art

FIG. 1 is a front view schematically showing the arrangement of a relevant portion of an image forming apparatus employing a non-contact type transfer roller system. This image forming apparatus is of a clamshell structure constituted by an upper part U and a lower part D. In the upper part U, a photoreceptor drum 1 is provided. In the lower part D, a roller 2, a transfer roller 3 and a pre-transfer guide 4 constituting a transfer apparatus TP, and a conveying guide 15 are provided. In the clamshell structure, since the upper part U is separated from the lower part D to open the conveying path of a recording sheet P, the removal of a jammed sheet and the repair are easy.

On the photoreceptor drum 1, a toner image has been formed by attaching charged toner thereto in advance. The transfer of the toner image to the recording sheet P is performed by the transfer apparatus TP. This is done by applying a voltage of a polarity opposite to that of the toner to the transfer roller 3 when the recording sheet P is fed in the gap between the photoreceptor drum 1 and the transfer roller 3. In the non-contact type transfer roller system, the transfer roller 3 is arranged to face the photoreceptor drum 1 with a predetermined gap between. This gap is formed by arranging at each end of the transfer roller 3 the roller 2 of a diameter slightly larger than that of the transfer roller 3. The roller 2 is in contact with the photoreceptor drum 1 outside of an image formed area on the surface of the photoreceptor drum 1.

The pre-transfer guide 4 guides the recording sheet P to the gap between the photoreceptor drum 1 and the transfer roller 3. The roller 2 and the transfer roller 3 are attached to a bearing (not shown) of a case (not shown) to which the pre-transfer guide 4 is attached, so that the roller 2, the transfer roller 3 and the pre-transfer guide 4 are in positioned condition.

The roller 2, the transfer roller 3 and the pre-transfer guide 4 are pushed toward the photoreceptor drum 1 by a spring 11 provided therebelow (provided on a base 7). For this reason, the roller 2 is pressed against the surface (portions other than the image formed area) of the photoreceptor drum 1, so that a predetermined gap is maintained between the photoreceptor drum 1 and the transfer roller 3. As a result, the transfer apparatus TP is displaceable so that the positions of the transfer roller 3 and the pre-transfer guide 4 depend on the position of the photoreceptor drum 1.

The reason why the transfer roller 3 and the pre-transfer guide 4 are pushed to be displaceable so that a predetermined gap is maintained between the photoreceptor drum 1 and the transfer roller 3 and that the positions of the transfer roller 3 and the pre-transfer guide 4 depend on the position of the photoreceptor drum 1 is that the Upward and downward variation of the position of the photoreceptor drum 1 readily occur in the clamshell structure in which the upper part U and the lower part D are separable from each other.

The recording sheet P on which the image has been transferred by the transfer roller 3 is conveyed from the transfer apparatus TP to the conveying guide 15. The conveying guide 15, which is fixed to the base 7 at its lower part, receives at its end portion **15*a*** the abutment of an end of the image transferred recording sheet P, and guides the recording sheet P to a fixing apparatus (not shown) arranged on the downstream side thereof.

Referring now to FIGS. 2A and 2B, an operation of the transfer apparatus TP performed when the photoreceptor drum 1 moves upward and downward will be described. FIG. 2A shows a positional relationship among the recording sheet P, the transfer apparatus TP and the conveying guide 15 when the photoreceptor drum 1 moves upward (in the direction of arrow mU). FIG. 2B shows a positional relationship among the recording sheet P, the transfer apparatus TP and the conveying guide 15 when the photoreceptor drum 1 moves downward (in the direction of arrow mD).

As shown in these figures, even if the photoreceptor drum 1 moves upward and downward, since the roller 2, the transfer roller 3 and the pre-transfer guide 4 are pushed by the spring 11 (FIG. 1), the positions of the transfer roller 3 and the pre-transfer guide 4 relative to the photoreceptor drum 1 do not vary.

However, since the conveying guide 15 is fixed to the base 7, the position of the conveying guide 15 relative to the photoreceptor drum 1, the transfer roller 3 and the pre-transfer guide 4 varies. Specifically, when the photoreceptor drum 1 moves upward, the distance between the photoreceptor drum 1 and the end portion **15*a* of the conveying guide 15 increases (FIG. 2A), and when the photoreceptor drum 1 moves downward, the distance between the photoreceptor drum 1 and the end portion 15*a* of the conveying guide 15 decreases (FIG. 2**B).

When the distance between the photoreceptor drum 1 and the end portion **15*a* is thus varied by the upward and downward movement of the photoreceptor drum 1, the position at which the end of the recording sheet P abuts the end portion 15*a* is varied. Thereby, the position of the recording sheet P relative to the photoreceptor drum 1 and the transfer roller 3 is varied, so that the transfer to the recording sheet P is unstable to cause non-uniformity in density. Further, since the abutment position of the end of the recording sheet P on the end portion 15*a* varies, if the end of the recording sheet P is not stably guided, the recording sheet P runs against the end portion 15*a*** to cause paper jam in the worst case.

The following three conditions must be satisfied in the process of conveying the image transferred recording sheet P from the transfer apparatus TP to the fixing apparatus. First, the recording sheet P should be separated from the surface of the photoreceptor drum 1 without being wound up around the photoreceptor drum 1 (i.e. an excellent separating capability). Second, the recording sheet P separated from the surface of the photoreceptor drum 1 should be conveyed without any gap formed between the sheet P and the upper surface of the conveying guide 15 (i.e. an excellent conveying capability). Third, a clear image should be secured after fixing without the transferred toner being scattered on the recording sheet P (i.e. no image scatter).

However, since the conventional conveying guide 15 is made of a material (e.g. acrylonitrile-butadiene-styrene copolymer (ABS) resin material having a comparatively high electric resistance) with which the excess charge does not readily flow from the charged recording sheet P, the separating capability is inferior.

Further, if the excess charge does not readily flow from the charged recording sheet P, a gap is formed between the upper surface of the conveying guide 15 and the recording sheet P separated from the surface of the photoreceptor drum 1, so that the conveying capability deteriorates. If a gap is formed between the recording sheet P and the upper surface of the conveying guide 15, the recording sheet P comes in contact with the upper part U located above the conveying path so that the toner image on the recording sheet P is rubbed. As a result, non-uniformity is caused in the image.

Conversely, when the conveying guide 15 is made of a material (e.g. an ABS resin material having a comparative low resistance and a metal) with which the excess charge readily flows from the charged recording sheet P after the transfer, since the charge rapidly flows from the recording sheet P, the toner transferred to the recording sheet P scatters.

Thus, since the separating and conveying capabilities of the image transferred recording sheet P and the image scatter on the recording sheet P depend on the electric resistance of the conveying guide 15, it is difficult to satisfy all of the above-mentioned three conditions.

SUMMARY OF THE INVENTION

An object of the present invention is to provide a transfer apparatus with which the non-uniformity in density and the paper jam are prevented by stably guiding a recording sheet on which an image has been transferred.

Another object of the present invention is to provide an image forming apparatus which has excellent capabilities of separating and conveying the recording sheet on which an image has been transferred, and in which no image scatter is caused on the recording sheet.

To achieve the above-mentioned objects, according to the present invention, in a transfer unit where a transfer roller which transfers a toner image to a recording sheet fed in a gap between a photoreceptor and the transfer roller, and a pre-transfer guide which guides the recording sheet are pushed to be displaceable so that a predetermined gap is maintained between the photoreceptor and the transfer roller and that the positions of the transfer roller and the pre-transfer guide depend on the position of the photoreceptor and the recording sheet on which an image has been transferred by the transfer roller is conveyed to a conveying guide, a post-transfer guide which receives the abutment of an end of the image transferred recording sheet and guides the recording sheet toward the conveying guide is provided to be displaceable integrally with the transfer roller and the pre-transfer guide.

The post-transfer guide is made of a resin with a resistance of $10^{10}\Omega$ to $10^{16}\Omega$.

Since the transfer roller and the pre-transfer guide are pushed to be displaceable so that their positions depend on the position of the photoreceptor, even if the position of the photoreceptor drum varies, the positions of the transfer roller and the pre-transfer guide relative to the photoreceptor do not vary. Since the post-transfer guide is provided to be displaceable integrally with the transfer roller and the pre-transfer guide, even if the positions of the transfer roller and the pre-transfer guide vary, the position of the post-transfer guide relative thereto does not vary. Therefore, even if the position of the photoreceptor varies, the position of the post-transfer guide relative to the photoreceptor does not vary, and the position of the recording sheet fed in the gap between the transfer roller and the photoreceptor in order to transfer an image thereto, relative to the photoreceptor does not vary. As a result, the end of the recording sheet on which an image has been transferred abuts the post-transfer guide substantially at a fixed position, and the recording sheet is stably guided to the conveying guide.

Further, when the post-transfer guide is made of a resin with a resistance of $10^{10}\Omega$ to $10^{16}\Omega$, the excess charge flows from the image transferred recording sheet through the post-transfer guide, so that the image transferred recording sheet is surely separated from the surface of the photoreceptor and conveyed without any gap formed between the sheet and the post-transfer and conveying guides. In addition, since the charge gradually flows from the recording sheet, toner does not scatter on the recording sheet after the transfer.

BRIEF DESCRIPTION OF THE DRAWINGS

These and other objects and features of this invention will become clear from the following description, taken in conjunction with the preferred embodiments with reference to the accompanied drawings in which.

DESCRIPTION OF THE PREFERRED EMBODIMENTS

Figure 1:
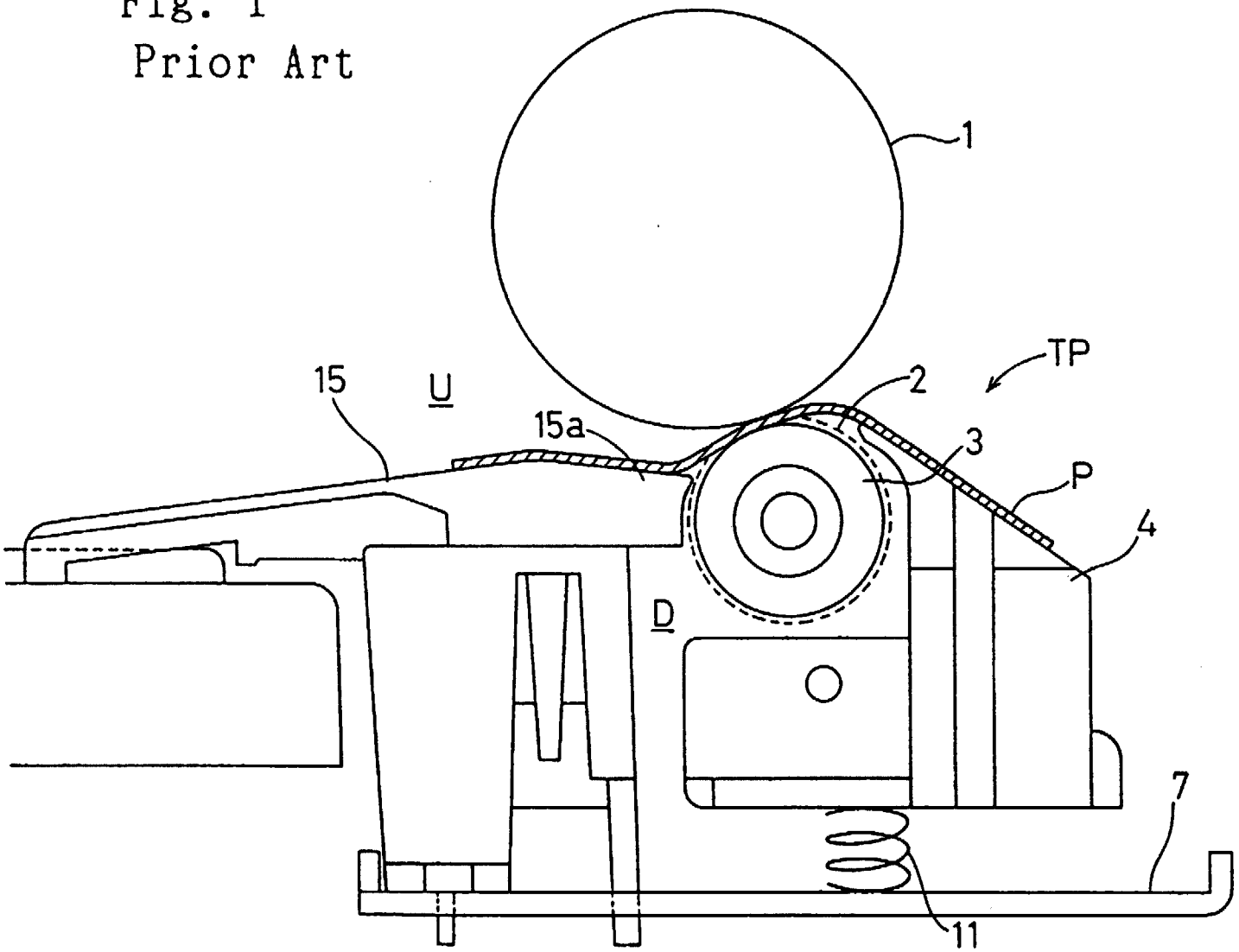
Fig. 1 Prior Art
FIG. 1 is a front view showing the arrangement of a relevant portion of an image forming apparatus employing a prior art.
Figure 2A:
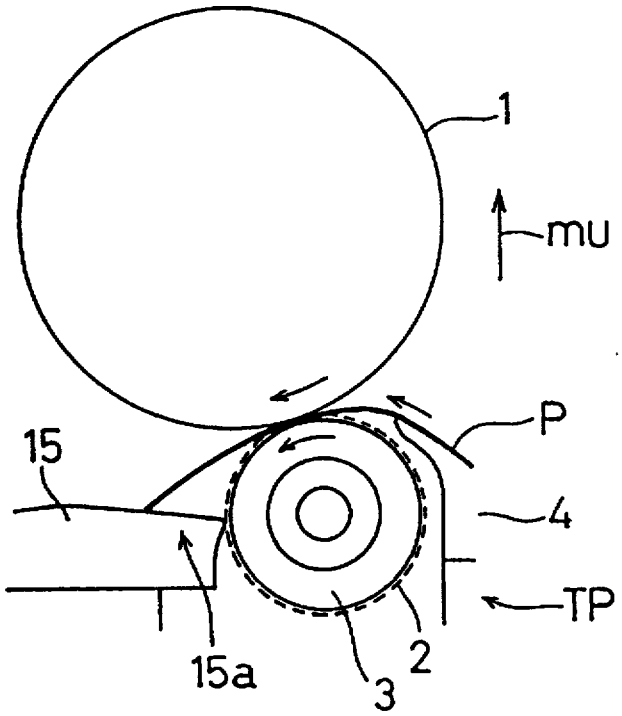
Fig. 2A Prior Art
FIG. 2A is a front view showing a positional relationship among a recording sheet, a transfer apparatus and a conveying guide when a photoreceptor drum moves upward in the prior art.
Figure 2B:
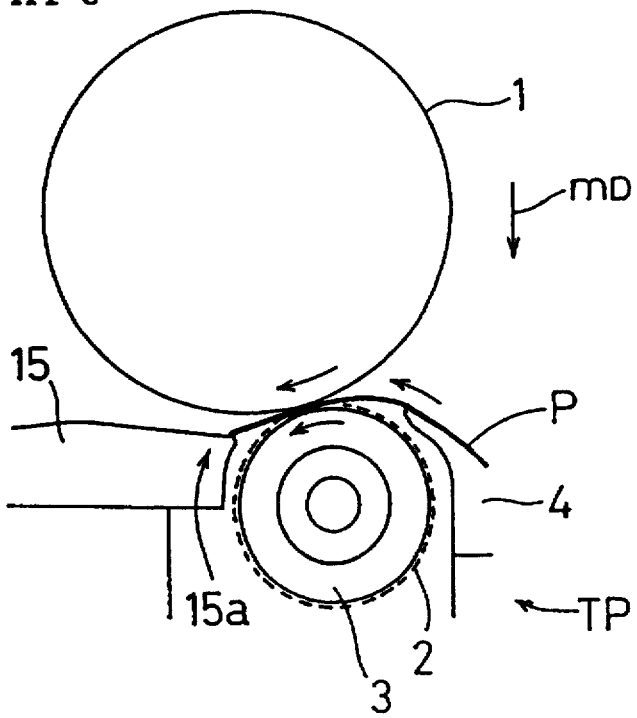
Fig. 2B Prior Art
FIG. 2B is a front view showing a positional relationship among the recording sheet, the transfer apparatus and the conveying guide when the photoreceptor drum moves downward in the prior art.
Figure 3:
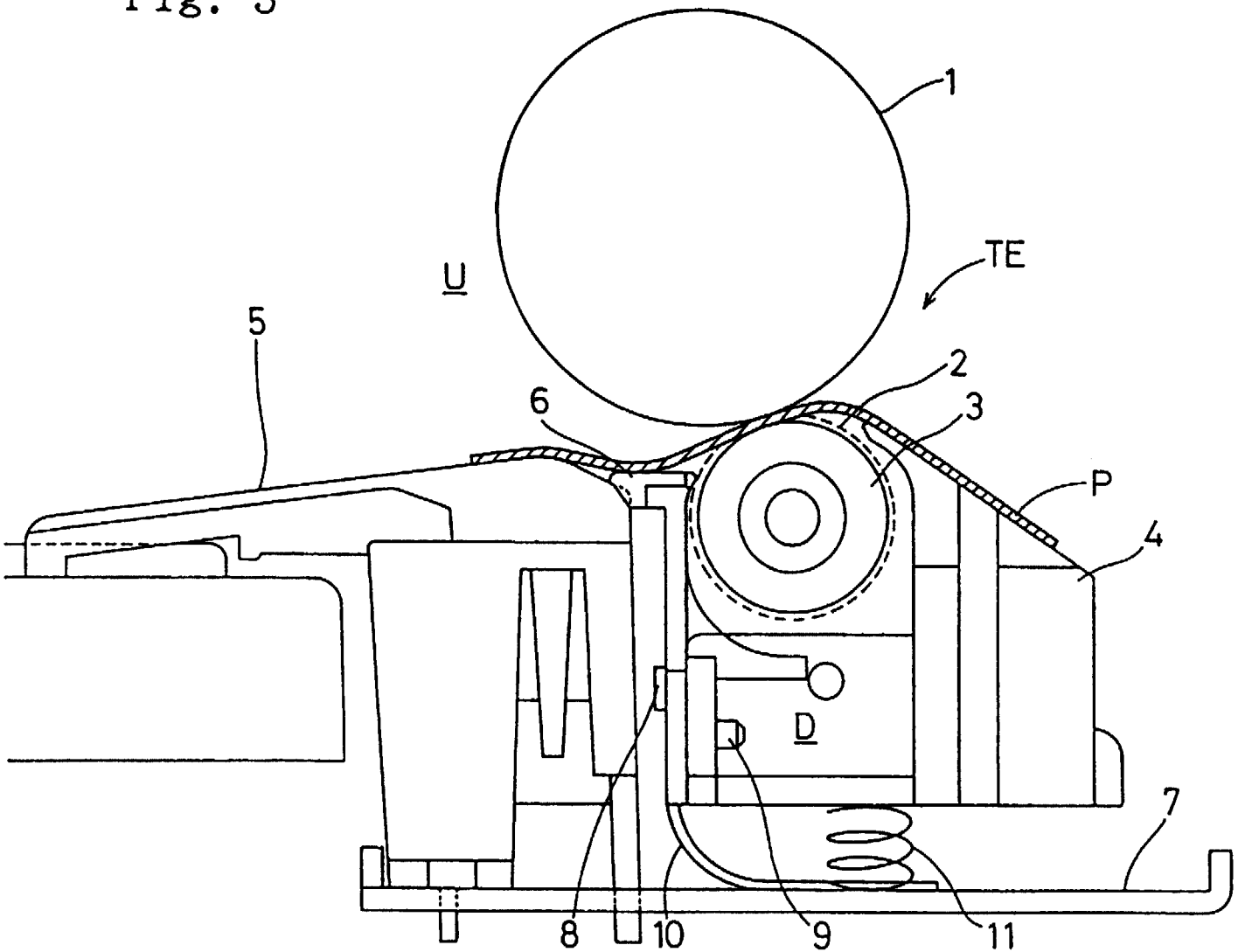
FIG. 3 is a front view showing the arrangement of a relevant portion of an image forming apparatus employing an embodiment of the present invention.

Hereinafter, an embodiment of the present invention will be described with reference to the drawings. Portions and elements the same as those of the conventional arrangement shown in FIGS. 1, 2A and 2B are identified by the same reference designations and will not be described in detail. Referring first to FIG. 3 showing an image forming apparatus employing this embodiment, a schematic arrangement of a transfer apparatus TE of this embodiment will be described.

The transfer apparatus TE includes a roller 2, a transfer roller 3, a pre-transfer guide 4, a post-transfer guide 6, a base 7 an earth plate 10 and a spring 11, and is characterized in that a post-transfer guide 6 which receives the abutment of an end of the image transferred recording sheet P and guides the recording sheet P to the conveying guide 5 is provided to be displaceable integrally with the roller 2, the transfer roller 3 and the pre-transfer guide 4. The post-transfer guide 6 and the conveying guide 5 are made of different materials.

In this embodiment, after the positioning of the post-transfer guide 6 relative to the pre-transfer guide 4 is made by a pin 9, the post-transfer guide 6 is relatively fixed to the pre-transfer guide 4 by a screw 8, so that the post-transfer guide 6 is displaceable integrally with the roller 2, the transfer roller 3 and the pre-transfer guide 4. Instead of fixing the post-transfer guide 6 in such a manner, an integration member of the pre-transfer guide 4 and the post-transfer guide 6 may be used.

Figure 4A:
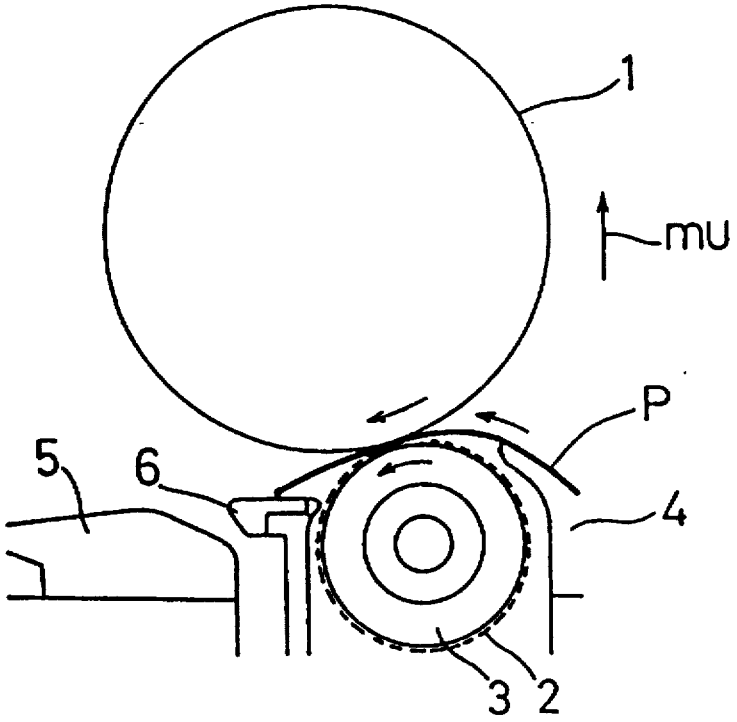
FIG. 4A is a front view showing a positional relationship among the recording sheet, the transfer apparatus and the conveying guide when the photoreceptor drum moves upward in the embodiment of the present invention.
Figure 4B:
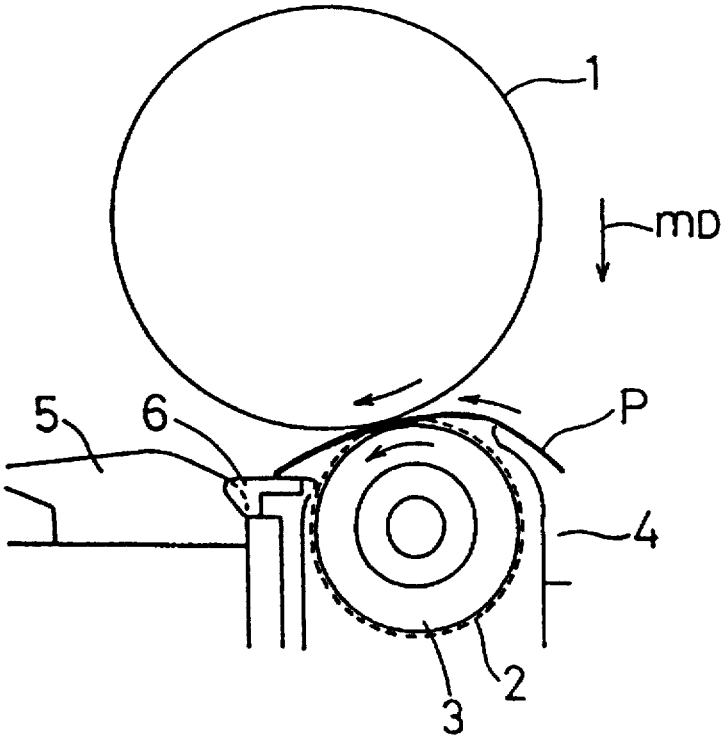
FIG. 4B is a front view showing a positional relationship among the recording sheet, the transfer apparatus and the conveying guide when the photoreceptor drum moves downward in the embodiment of the present invention.

Referring now to FIGS. 4A and 4B, an operation of the transfer apparatus TE performed when the photoreceptor drum 1 moves upward and downward will be described. FIG. 4A shows a positional relationship between the recording sheet P, the transfer apparatus TE and the conveying guide 5 when the photoreceptor drum moves upward (in the direction of arrow mU). FIG. 4B shows a positional relationship between the recording sheet P, the transfer apparatus TE and the conveying guide 5 when the photoreceptor drum 1 moves downward (in the direction of arrow mD).

Since the roller 2, the transfer roller 3 and the pre-transfer guide 4 are pushed to be displaceable by the spring 11 with the roller 2 pressed against the surface of the photoreceptor drum 1, their positions depend on the position of the photoreceptor drum 1. Therefore, even if the position of the photoreceptor drum varies upward and downward, the positions of the roller 2, the transfer roller 3 and the pre-transfer guide 4 relative to the photoreceptor drum 1 do not vary.

Since the post-transfer guide 6 is provided to be displaceable integrally with the roller 2, the transfer roller 3 and the pre-transfer guide 4, even if the positions of the transfer roller 3 and the pre-transfer guide 4 vary, the position of the post-transfer guide 6 relative thereto does not vary.

Therefore, even if the position of the photoreceptor drum 1 varies upward and downward, the position of the post-transfer guide 6 relative to the photoreceptor drum 1 (in other words, the distance between the photoreceptor drum 1 and the post-transfer guide 6) does not vary, so that the position of the post-transfer guide 6 relative to the recording sheet P on which an image has been transferred does not vary. As a result, the end of the image transferred sheet P abuts the post-transfer guide 6 substantially at a fixed position, and the recording sheet P is stably guided to the conveying guide 5.

As described above, since the recording sheet P is stably guided even if the position of the photoreceptor drum 1 varies, the position of the recording sheet P relative to the photoreceptor drum 1 and the transfer roller 3 does not vary. As a result, no non-uniformity in density is caused due to the transfer, which enables a transfer of uniform density. Since it is prevented that the recording sheet P runs against the post-transfer guide 6 to cause paper jam, the recording sheet P is stably conveyed. By forming the transfer apparatus TE into a unit with the post-transfer guide 6 attached thereto, a transfer unit is realized having excellent assembly and maintenance capabilities.

In the previously-described prior art (FIGS. 1, 2A and 2B), since the conveying guide 15 is fixed to the base 7, the position of the end portion 15*a* corresponding to the post-transfer guide 6 relative to the photoreceptor drum 1 and the transfer roller 3 is not fixed. Therefore, if the distance between the photoreceptor drum 1 and the post-transfer guide 6 is varied by the upward and downward movement of the photoreceptor drum 1, the abutment position Of the end of the recording sheet P on the end portion 15*a* varies, so that the advantages of the above-described embodiment cannot be obtained.

The post-transfer guide 6 is made of a resin having moderate electric conductivity (e.g. HN901 manufactured by JSR with an electric resistance of $3\times10^{12}\Omega$). The post-transfer guide 6 is provided with the flat spring form earth plate 10 in contact with the base 7 having a good conductivity. The base 7 is connected to a ground potential point of the image forming apparatus. Since the post-transfer guide 6 is made of a resin with a resistance of $10^{10}\Omega$ to $10^{16}\Omega$, the excess charge flows from the image transferred recording sheet P to the ground potential point by way of the post-transfer guide 6 and the earth plate 10, so that the image transferred recording sheet P is surely separated from the surface of the photoreceptor drum 1.

Since the recording sheet P is conveyed without any gap formed between the sheet P and the post-transfer and conveying guides 6 and 5, it does not occur that the toner on the recording sheet P is rubbed by the contact with the upper part U to cause non-uniformity in the image. Further, since the charge gradually flows from the recording sheet P, the toner does not scatter on the image transferred recording sheet P. Thus, with the transfer apparatus TE, the excellent separating and conveying capabilities and the prevention of the image scatter are both achieved.

The problem caused by the upward and downward variation of the position of the photoreceptor drum 1 is solved by the above-described arrangement. One possible cause of the upward and downward variation of the position of the photoreceptor drum 1 is the opening and closing of the upper part U for removing a jammed paper. Another possible cause is the non-uniformity of the position of the photoreceptor drum 1 among products caused during manufacture. The present invention is effective in either case.

As described above, according to the transfer apparatus of the present invention, the transfer roller and the pre-transfer guide are pushed to be displaceable so that a predetermined gap is maintained between the photoreceptor and the transfer roller and that the positions of the transfer roller and the pre-transfer guide depend on the position of the photoreceptor, and the post-transfer guide which receives the abutment of the end of the recording sheet on which the image has been transferred and guides the recording sheet to the conveying guide is provided to be displaceable integrally with the transfer roller and the pre-transfer guide, so that even if the position of the photoreceptor varies, the image transferred recording sheet is stably guided. As a result, the non-uniformity in density and the paper jam are prevented.

Further, the post-transfer guide is made of a resin with a resistance of $10^{10}\Omega$ to $10^{16}\Omega$, so that a transfer apparatus is realized which has excellent capabilities of separating and conveying the recording sheet and in which no image scatter is caused on the recording sheet.

Obviously, many modifications and variations of the present invention are possible in light of the above teachings. It is therefore to be understood that within the scope of the appended claims, the invention may be practiced other than as specifically described.

What is claimed is:

1. A transfer apparatus in which a transfer roller and a pre-transfer guide are pushed to be displaceable so that a predetermined gap is maintained between a photoreceptor and the transfer roller and that a position of the transfer roller and a position of the pre-transfer guide depend on a position of the photoreceptor such that a displacement in position of the photoreceptor is conformed to by a conforming displacement in the position of the transfer roller and position of the pre-transfer guide, and a recording sheet on which an image has been transferred by the transfer roller is conveyed to a conveying guide, said transfer roller transferring a toner image to the recording sheet fed in the gap between the photoreceptor drum and the transfer roller, said pre-transfer guide guiding the recording sheet, wherein a post-transfer guide which receives an abutment of an end of the recording sheet is provided to be displaceable integrally with the transfer roller and the pre-transfer guide, said post-transfer guide guiding the recording sheet to the conveying guide.

2. A transfer apparatus according to claim 1, wherein said post-transfer guide is made of a resin with a resistance of $10^{10}\Omega$ to $10^{16}\Omega$, and wherein said post-transfer guide is connected to a ground potential point through an earth plate.

3. A transfer apparatus according to claim 1, wherein said transfer roller, said pre-transfer guide and said post-transfer guide are displaceable through a translational movement whereby an amount of displacement of said post-transfer guide coincides with an amount of displacement of said pre-transfer guide.

4. A transfer apparatus according to claim 1, wherein a line extending from a center of said photoreceptor to a center of said transfer roller extends in a downstream to upstream direction with respect to a sheet feed direction.

5. A transfer apparatus as recited in claim 1 further comprising a gap forming roller provided at an end of the transfer roller for forming the gap between the photoreceptor and the transfer roller, said gap forming roller having a diameter larger than a diameter of the transfer roller and said transfer apparatus further comprising a biasing device which presses said gap forming roller against the surface of the photoreceptor.

6. A transfer apparatus according to claim 1 wherein said pre-transfer guide forms part of a unitary displaceable unit which unit is maintained in contact with said photoreceptor despite adjustments in photoreceptor position.

7. A transfer apparatus according to claim 6 wherein said displaceable unit further comprises a pressing roller which shares a common rotation axis with said transfer roller and is placed in contact with the photoreceptor, and said pressing roller having a diameter larger than said transfer roller so as to maintain the predetermined gap between the photoreceptor and transfer roller.

8. A transfer apparatus according to claim 6 wherein said displaceable unit includes a holding member which supports said pre-transfer guide, post-transfer guide, transfer roller, and pressing roller.

9. An apparatus according to claim 8 wherein said post-transfer guide includes a pin member which is received by an aperture in said holding member and said displaceable unit further comprising a set screw for releasably fixing the post-transfer guide to said holding member.

10. A transfer apparatus in which a transfer roller and a pre-transfer guide are pushed to be displaceable so that a predetermined gap is maintained between a photoreceptor and the transfer roller and that a position of the transfer roller and a position of the pre-transfer guide depend on a position of the photoreceptor, and a recording sheet on which an image has been transferred by the transfer roller is conveyed to a conveying guide, said transfer roller transferring a toner image to the recording sheet fed in the gap between the photoreceptor drum and the transfer roller, said pre-transfer guide guiding the recording sheet, wherein a post-transfer guide which receives an abutment of an end of the recording sheet is provided to be displaceable integrally with the transfer roller and the pre-transfer guide, said post-transfer guide guiding the recording sheet to the conveying guide, and wherein said post-transfer guide is made of a resin with a resistance of $10^{10}\Omega$ to $10^{16}\Omega$.

11. A transfer apparatus as recited in claim 10 further comprising a gap forming roller provided at an end of the transfer roller for forming the gap between the photoreceptor and the transfer roller, said gap forming roller having a diameter larger than a diameter of the transfer roller and said transfer apparatus further comprising a biasing device which presses said gap forming roller against the surface of the photoreceptor.

12. A transfer apparatus according to claim 10 wherein said pre-transfer guide, post-transfer guide and transfer roller form part of a unitary displaceable unit which unit is maintained in contact with said photoreceptor despite adjustments in photoreceptor position.

13. A transfer apparatus according to claim 12 wherein said displaceable unit further comprises a pressing roller which shares a common rotation axis with said transfer roller and is in contact with the photoreceptor, and said pressing roller having a diameter larger than said transfer roller so as to maintain the predetermined gap between the photoreceptor and transfer roller.

14. A transfer apparatus comprising:

a photoreceptor drum, a toner image being formed on a surface of said photoreceptor drum;

a transfer roller which transfers a toner image to a sheet fed in a gap between the photorecephor drum and the transfer roller;

a pre-transfer guide which guides the sheet;

a conveying guide which guides the sheet on which an image has been transferred;

a post-transfer guide which directs to the conveying guide the sheet on which an image has been transferred, said post-transfer guide being made of a resin with a resistance of $10^{10}\Omega$ to $10^{16}\Omega$, and wherein said post-transfer guide is connected to a ground potential point through an earth plate;

a holding member which integrally holds the transfer roller, the pre-transfer guide and the post-transfer guide; and a spring which pushes the holding member toward the photoreceptor drum.

15. A transfer apparatus comprising:

a photoreceptor drum for carrying a toner image on a surface thereof;

a transfer roller arranged below the photoreceptor drum for transferring the image onto a sheet fed in between said transfer roller and the photoreceptor drum;

a gap forming roller provided at an end of the transfer roller for forming a gap between the photoreceptor drum and the transfer roller, said gap forming roller having a diameter larger than a diameter of the transfer roller and being pressed against the surface of the photoreceptor drum by an upward force;

a pre-transfer guide for guiding the sheet in the gap;

a conveying guide for guiding the sheet away from the photoreceptor drum and the transfer roller after the image has been transferred thereon;

a post-transfer guide for directing the sheet from the gap to the conveying guide;

a holding member for holding the transfer roller, the pre-transfer guide, and the post-transfer guide integrally, said holding member being displaceable upward and downward;

a spring for providing the holding member with an upward translational force so that the gap forming roller is pressed against the surface of the photoreceptor; and wherein said post-transfer guide has a contact surface which is dimensioned to conform to a shape of a corresponding contact surface of said conveying guide, which conveying guide is positioned downstream from said post-transfer guide such that when said transfer apparatus is in position in an image forming apparatus, said post-transfer guide is adapted to contact the conveying guide when in a lowermost position of displacement.

* * * * *